US005490774A

United States Patent [19]

Mann et al.

[11] Patent Number: 5,490,774

[45] Date of Patent: Feb. 13, 1996

[54] OIL GUN MOUNTING FOR USE IN STEAM GENERATION BOILERS

[75] Inventors: Jeffrey S. Mann, Broad Brook; John F. Shea, Newington, both of Conn.; Ronald J. Tenerowicz, Agawam, Mass.

[73] Assignee: Combustion Engineering, Inc., Windsor, Conn.

[21] Appl. No.: 313,960

[22] Filed: Sep. 28, 1994

[51] Int. Cl.[6] ..... F23D 11/36

[52] U.S. Cl. ..... 431/154; 122/447

[58] Field of Search ..... 431/153, 154, 431/155, 159, 186, 189, 188; 110/260, 104 B, 347; 122/446, 449, 447

[56] References Cited

U.S. PATENT DOCUMENTS

| | | | |
|---|---|---|---|
| 2,777,509 | 1/1957 | Beckett | 431/154 |
| 3,100,461 | 8/1963 | Werner | 431/189 |
| 3,606,610 | 9/1971 | Leach | 431/153 |
| 4,434,747 | 3/1984 | Chadshay | 122/449 |
| 5,044,327 | 9/1991 | Hunt | 431/186 X |
| 5,087,194 | 2/1992 | Viessman | 431/159 |

*Primary Examiner*—Denise L. Gromada
*Assistant Examiner*—Susanne C. Tinker
*Attorney, Agent, or Firm*—Robert S. Smith

[57] ABSTRACT

A mounting for an oil gun in an associated steam generation boiler which includes a stationary union block having first and second output ports for respective fluid streams; a removable block having first and second input ports dimensioned and configured for registration with the first and second output ports; apparatus for mounting the stationary union block which comprises a collar welded to the end of an associated guide pipe and apparatus coupling the collar and the stationary union block and allowing relative pivotal moment between the collar and the stationary union; and apparatus for forcing the removable union block against the stationary union block with the respective ports thereof in registered relationship. In some forms of the invention the apparatus coupling the collar and the stationary union comprises a pin, the pin extending through the stationary union block. The apparatus coupling the collar and the stationary union block may comprise first and second plates that are carried on the pin. In some forms of the invention the first and second plates are disposed in spaced relation and are welded to the collar. The apparatus for forcing the removable union block against the stationary union block may comprise a yoke and the yoke may be carried on the pin. The apparatus for forcing may further include a bolt shaped member and a transversely extending handle.

8 Claims, 3 Drawing Sheets

OIL GUN MOUNTING FOR USE IN STEAM GENERATION BOILERS

BACKGROUND OF THE INVENTION

The invention relates to steam generation boilers. More particularly, the invention relates to oil fired steam generation boilers and particularly to the mounting for one or more oil guns in such apparatus.

The oil gun mountings which have been used commonly often present problems in aligning a removable portion of the oil gun with respect to a stationary mounting for the oil gun. Each of the oil guns is typically mounted on one of the windboxes disposed at each of the respective corners of the furnace cavity.

The alignment of the respective portions of each oil gun is important to insure proper seating of gaskets between the portions.

It is an object of the present invention to provide apparatus that will facilitate alignment of the oil gun and the mounting for the oil gun and thus proper seating of the gasket therebetween.

Another object of the invention is to provide apparatus which is more structurally sound and secure than known constructions.

Still another object of the invention is to provide apparatus that will be less costly to maintain because of the easier assembly as well as less costly to construct.

SUMMARY OF THE INVENTION

It has now been found that these and other objects of the invention may be attained in a mounting for an oil gun in an associated steam generation boiler which includes a stationary union block having first and second output ports for respective fluid streams; a removable block having first and second input ports dimensioned and configured for registration with the first and second output ports; means for mounting the stationary union block which comprises a collar welded to the end of an associated guide pipe and means coupling the collar and the stationary union block and allowing relative pivotal moment between the collar and the stationary union; and means for forcing the removable union block against the stationary union block with the respective ports thereof in registered relationship.

In some forms of the invention the means coupling the collar and the stationary union comprises a pin, the pin extending through the stationary union block. The means coupling the collar and the stationary union block may comprise first and second plates that are carried on the pin. In some forms of the invention the first and second plates are disposed in spaced relation and are welded to the collar. The means for forcing the removable union block against the stationary union block may comprise a yoke and the yoke may be carried on the pin. The means for forcing may further include a bolt shaped member and a transversely extending handle.

BRIEF DESCRIPTION OF THE DRAWINGS

The invention will be better understood by reference to the accompanying drawing in which.

DESCRIPTION OF THE PREFERRED EMBODIMENTS

Figure 1:
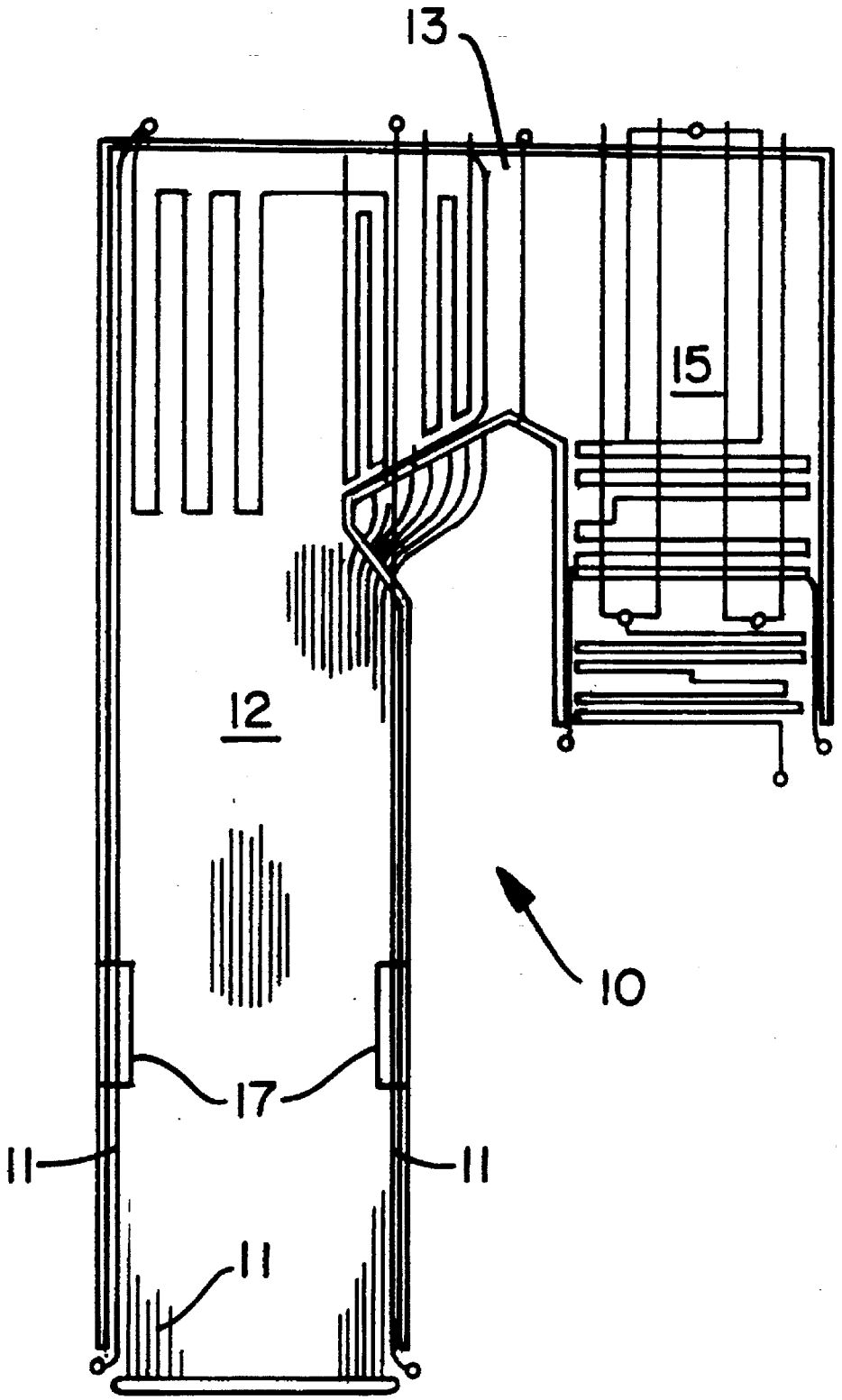
FIG. 1 is a side elevational view of a furnace of the type that may utilize the present invention.

Referring now to FIG. 1 there is shown a conventional furnace 10, including waterwalls 11. It will be understood that the present invention may be incorporated in a wide variety of furnace structures and that the illustrated furnace 10 is only one such furnace. The furnace 10 is vertically disposed and has an outlet for combustion gases at the upper end thereof that extends from the rear wall thereof. Extending from this outlet is a lateral gas pass 13 which connects with the upper end of a vertically extended gas pass 15 that extends downwardly in parallel relation with the furnace 10. Combustion gases sequentially pass through the furnace cavity 12, the lateral gas pass 13, the vertically extended gas pass 15 and a stack (not shown). The furnace 10 is provided with burners 17. The furnace 10 includes a front wall and a rear wall. Side walls (not shown) are disposed in spaced relationship and join the front wall and the rear wall. The front, rear, and side walls are each waterwalls 11. Each waterwall 11 comprises a plurality of tubular members.

Figure 3:
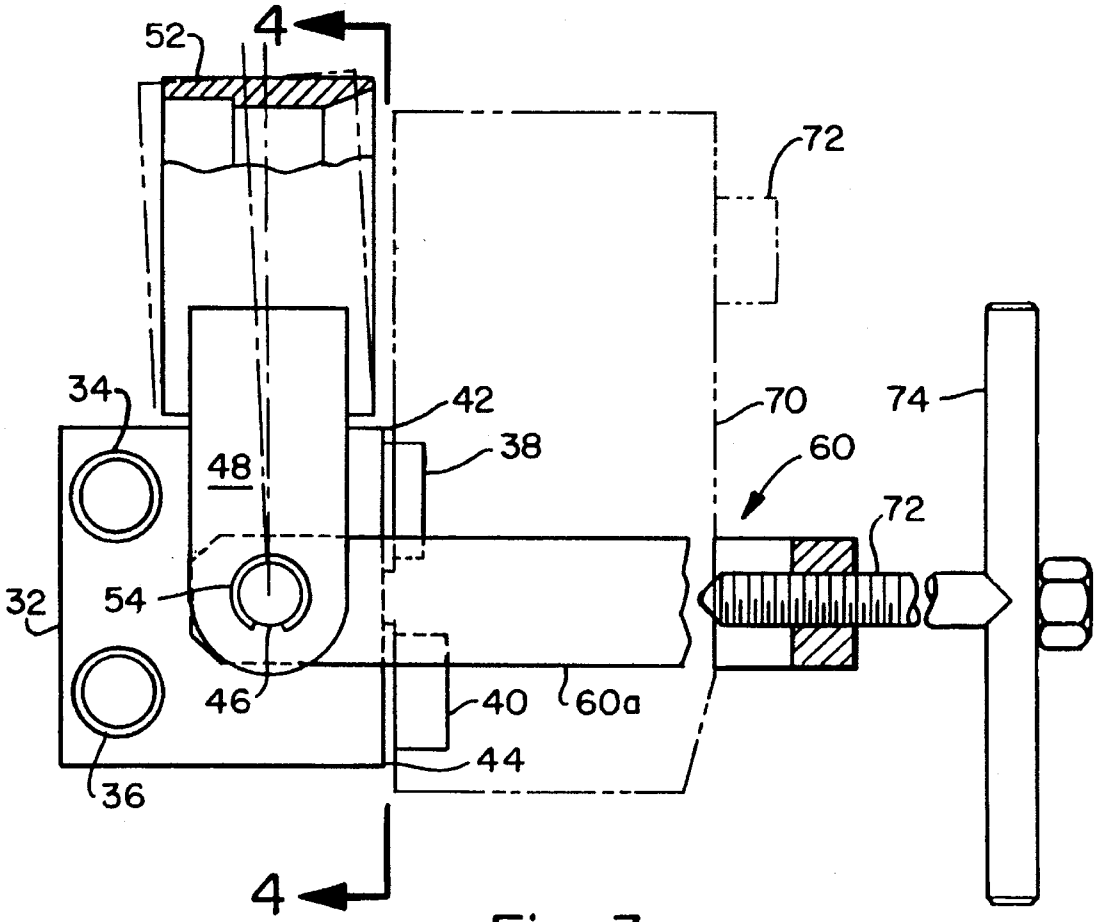
FIG. 3 is a simplified side elevational view, similar to FIG. 2, showing portions of the apparatus illustrated in figure to a larger scale.
Figure 2:
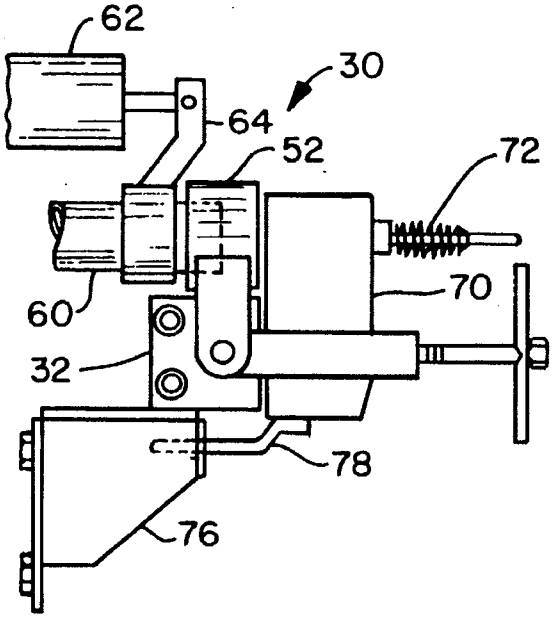
FIG. 2 is a side elevational view of the oil gun apparatus accordance with one form of the invention.
Figure 4:
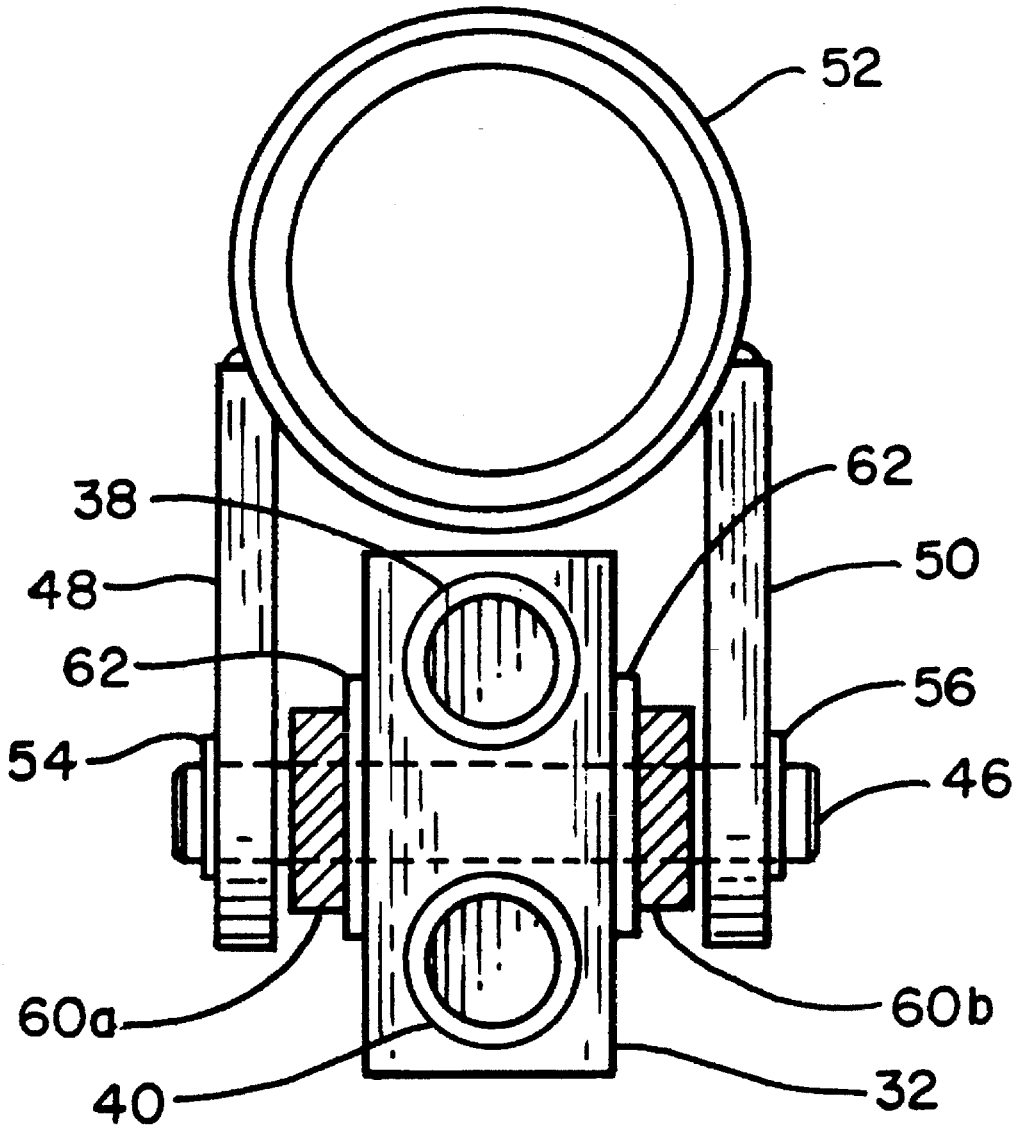
FIG. 4 is a view taken along the line 4—4 of FIG. 3.

The present invention relates to the individual oil guns that are a pad of the burners 17. Referring now particularly to FIGS. 2, 3, 4 there is shown an oil gun mounting 30 in accordance with one form of the present invention. The mounting 30 includes a stationary union block 32. The stationary union block 32 is held or fixed in place with respect to the waterwalls 11. More particularly, the stationary union block 32 is ordinarily fixed to a windbox (not shown). The stationary union block 32 is provided with a first inlet port 34 and a second inlet port 36. The ports 34 and 36 are typically provided with pipe threads (not shown) for cooperation with associated pipes (not shown). For some installations the associated pipes may both carry oil. In other installations the associated pipes may carry oil in one pipe and steam or air in the other associated pipe. The stationary union block 32 includes respective internal L-shaped passageways leading respectively to output ports 38, 40. The output ports 38, 40 are each provided with raised annular rims that are raised with respect to the face of the stationary union 32. The outlet ports 38, 40 are provided respectively with gaskets 42, 44.

A pin 46 extends through the stationary union 32. A first plate 48 and a second plate 50 are provided with respective holes through which the pin 46 extends. The plates 48, 50 are welded to opposite sides of a collar 52. The C-clips 54, 56 are provided at the axial extremities of the pin 46. The C-clips 54, 56 cooperate with circumferential grooves (not shown)in the pin 46 to prevent moment of the plates 48, 50 off the pin 46.

It will be understood that the collar 52 is welded to the end of a telescopic guide pipe 62. Those skilled in the art will recognize that it is conventional to mount the oil gun on such a telescopic guide pipe 62 and that it is conventional to provide an air cylinder 66 or equivalent apparatus coupled by an arm 64 to the telescopic guide pipe 62. In this manner the air cylinder 66 may be operated to telescope the guide pipe 62 and retract the oil gun from the extreme temperatures within the furnace cavity 12. It will be greater understood that when operation of the oil gun is required the telescopic guide pipe 62 may be extended to position the oil gun closer to the furnace cavity 12.

The pin 46 also engages respective bores in the legs 60*a*, 60*b* of a yoke 60. As best seen in FIG. 4, the legs 60*a* and 60*b* are disposed just inboard, respectively, of the plates 48, 50. Disposed intermediate the stationary union 32 and respectively the legs 60*a*, 60*b* are washers 68, 68.

The yoke 60 is dimensioned and configured to bridge a removable union 70 as best seen in FIG. 4. The removable union 70 is a part of an oil gun. More particularly, the removable union 70 is fixed to the rest of the structure of the oil gun. The removable union 70 is provided with a handle 72 that includes a portion that is a helix shaped wire. The handle 72 is shaped in this manner to allow dissipation of heat. Those skilled in the art will recognize that the closeness of the oil gun and the removable union 70 to the combustion process in the furnace cavity 12 during normal operation will result in the removable union 70 becoming very hot. Thus, the helix shaped handle 72 is provided to avoid the risk of injury to those manipulating the removable union 70 during normal maintenance and operational procedures. It will be understood that the handle 72 shown in FIG. 2 is represented in a simplified form in FIG. 3.

A bolt shaped member 80 engages with threads thereon a threaded bore in the yoke 60. A transversely extending bar 74 is carried on the bolt shaped member 80 to enable a user to clamp the removable union 70 to the stationary union block 32.

Those skilled in the art will recognize that two pipes extend from the removable union 70. These two pipes have been omitted from the drawing to improve clarity. The two pipes that are not shown extend from the left (as viewed) face of the removable union 70. More particularly, the two pipes extend within the collar 52 and within the guide pipe 60. In other words, the two pipes direct oil or a combination of oil and steam or air or another fluid to the rest of the oil gun and ultimately to the cavity 12.

Because the furnace apparatus is operated remotely it is of importance for a remote operator to have an indication that the stationary union block 32 is properly seated against the renewable union 70. This information is provided by a switch assembly 76 that is fixed to the stationary union block 32. Cooperating with the switch assembly 76 is a rod 78 that is fixed to the removable union 70. When the rod 78 is not fully seated with the switch assembly 76 the electrical switch within the switch assembly 76 is in a first position. When the rod 70 is fully seated in the switch assembly 76 the electrical switch in the switch assembly 76 is in a second position. Thus those skilled in the art will recognize that a remote indication can easily be provided.

In operation, the removable union 70 is manually positioned, using the handle 72, with the ports thereof generally aligned with the output ports 38, 40 of the stationary union block 32. It will be understood that the removable union block 70 will be disposed within the yoke 60 and that the collar 52 is welded to the guide pipe 60. Thereafter, the bolt shaped member 80 is rotated to firmly engage the ports of the removable union 70 with the output ports 38, 40 of the stationary union block 32. Because the guide pipe 60 is relatively fixed, because of the relative size and mass of the guide pipe 60, the stationary union block 32 will move slightly to provide proper alignment with the removable union block 70. Although FIG. 3 has been drawn with dotted lines to indicate the alternative positions of the collar 52 it will be understood by those skilled in the art that the collar 52 is substantially fixed in space and that the stationary union block 32 pivots within the physical constraints of the structure. The physical constraint is the space intermediate the collar 52 and the stationary union block 32. The space involved is the space above of the stationary union block 32 (as viewed) that is intermediate the collar 52 and the top (as viewed) of the stationary union block 32. In other words, the stationary union block 32 can pivot about the pin 46 to align with the ports of the removable union 70.

It will thus be seen that the oil gun mounting in accordance with the present invention allows for precise alignment of the ports of the stationary union block 32 and the ports of the removable union block 70. It will also be seen that this apparatus in accordance with the invention provides positive seating between the removable union block 70 and the stationary union block 32.

The invention has been described with reference to its illustrate preferred embodiment. Persons skilled in the art of such devices may upon exposure to the teachings herein conceive other variations. Such variations are deemed to be encompassed by the disclosure, the invention being limited only by the following claims.

What is claimed is:

1. A mounting for an oil gun in an associated steam generation boiler which comprises:

a stationary union block having first and second output ports for respective fluid streams;

a removable block having first and second input ports dimensioned and configured for registration with said first and second output ports;

means for mounting said stationary union block which comprises a collar welded to an end of an associated guide pipe and means coupling said collar and said stationary union block and allowing relative pivotal moment between said collar and said stationary union; and means for forcing said removable union block against said stationary union block with the respective ports thereof in registered relationship.

2. The apparatus as described in claim 1 wherein:

said means coupling said collar and said stationary union comprises a pin, said pin extending through said stationary union block.

3. The apparatus as described in claim 2 wherein:

said means coupling said collar and said stationary union block comprises first and second plates, said first and second plates being carried on said pin.

4. The apparatus as described in claim 3 wherein:

said first and second plates are disposed in spaced relation and are welded to said collar.

5. The apparatus as described in claim 4 wherein:

said means for forcing said removable union block against said stationary union block comprises a yoke.

6. The apparatus as described in claim 5 wherein:

said yoke is carried on said pin.

7. The apparatus as described in claim 6 wherein:

said means for forcing further includes a bolt shaped member.

8. The apparatus as described in claim 7 wherein:

said means for forcing further includes a transversely extending handle.

* * * * *